US006540546B2

(12) United States Patent
Kubo

(10) Patent No.: US 6,540,546 B2
(45) Date of Patent: Apr. 1, 2003

(54) CONNECTOR PROVIDED WITH A COVER

(75) Inventor: Akinobu Kubo, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 30 days.

(21) Appl. No.: 09/742,441

(22) Filed: Dec. 22, 2000

(65) Prior Publication Data

US 2001/0016451 A1 Aug. 23, 2001

(30) Foreign Application Priority Data

Dec. 27, 1999 (JP) ..... 11-371622

(51) Int. Cl.[7] ..... H01R 13/58
(52) U.S. Cl. ..... 439/468; 439/460; 439/157
(58) Field of Search ..... 439/468, 460, 439/466, 157, 456, 470, 471, 472, 473, 153, 447, 446

(56) References Cited

U.S. PATENT DOCUMENTS 4,127,316 A * 11/1978 McKee et al. ..... 339/103
4,195,899 A * 4/1980 Raddloff ..... 339/103
4,214,803 A * 7/1980 McKee et al. ..... 339/103
5,076,802 A * 12/1991 Colleran et al. ..... 439/468
5,322,448 A * 6/1994 Hahn ..... 439/157
5,460,534 A * 10/1995 Taniuchi et al. ..... 439/157
5,695,358 A * 12/1997 Myer et al. ..... 439/468
5,938,458 A * 8/1999 Krehbiel et al. ..... 439/157
6,030,237 A * 2/2000 Roth ..... 439/157
6,350,147 B2 * 2/2002 Brownell et al. ..... 439/468

FOREIGN PATENT DOCUMENTS

EP 691 040 6/1997
WO WO 94/22183 9/1994

* cited by examiner

*Primary Examiner*—P. Austin Bradley
*Assistant Examiner*—Alexander Gilman
(74) *Attorney, Agent, or Firm*—Banner & Witcoff, Ltd.

(57) ABSTRACT

The invention provides a means for preventing foreign matter from entering via a supplementary guiding hole into an electrical connector provided with a cover. After female terminal fittings have been inserted into cavities of a female housing 40, this female housing 40 is inserted into a cover 20 via an attachment hole 21 that opens onto a side face of a closer side of the cover 20. Electric wires W that extend from a posterior end of the female housing 40 are passed through a guiding hole 22 adjacent to the attachment hole 21, and are guided towards the closer side in the direction of an arrow A. In the case where a different, closer, pair of male and female connectors M and F are fitted together after a female connector F has been fitted to a male connector M, the electric wires W are passed through a supplementary guiding aperture 50 that adjoins a lower side of a hole edge of the guiding hole 22, and are guided downwards in the direction of an arrow B. When the male and female connectors M and F are in their final position, this supplementary guiding hole opens in a vertical direction.

18 Claims, 6 Drawing Sheets

CONNECTOR PROVIDED WITH A COVER

TECHNICAL FIELD

The present invention relates to an electrical connector provided with a cover.

BACKGROUND TO THE INVENTION

One example of a connector provided with a cover has this cover on a posterior face of a housing, this allowing a group of electric wires that extend from the posterior face of the housing to be guided in a direction that is at a 90 degree angle to their extending direction by using, for example, a space at the posterior face of the housing. An example of this type of connector is described in JP-8-508131. As shown in FIG. 10 of this specification, a cover 1 of this connector is capable of entirely covering a housing 2. After terminal fittings have been inserted from above into the housing 2, the fitting face of this housing 2 facing downwards, the housing 2 is housed within the cover 1 by being passed through an attachment hole 3 that opens to the left relative to FIG. 10, and a group of electric wires 4 that extend from a posterior face of the housing 2 are bent to an angle of 90 degrees to the left and are guided away through a guiding hole 5 that adjoins an upper side of the attachment hole 3.

The first connector is fitted so as to face downwards relative to a corresponding connector that is attached in an upwardly facing manner to a printed wiring board. Since the group of electric wires 4 are guided to the left of the fitted position of the first connector, they may interfere with a second connector when this is to be fitted. In order to deal with this problem, a supplementary guiding hole 7 opens into an upper wall 6 of the guiding hole 5 in this connector. In the case where the connector fitting operation of the second connector is performed at the left, the group of electric wires 4 is passed through the supplementary guiding hole 7 and is temporarily moved upwards. After the fitting operation has been completed, the group of electric wires 4 is then guided back to the left through the guiding hole 5.

In the conventional connector, the supplementary guiding hole 7 remains open in an upwards direction after the group of electric wires 4 has returned to its original position. As a result, depending on the location of the connector, there is the possibility that foreign matter or dust may enter the housing 2 via the supplementary guiding hole 7. In particular, foreign matter accumulates when the connector has been used for a long period with the supplementary guiding hole 7 remaining open.

The present invention has taken the above problem into consideration, and aims to present a connector provided with a cover which has a means for preventing foreign matter from entering through a supplementary guiding hole.

SUMMARY OF THE INVENTION

According to a first aspect the invention provides a cover for an electrical connector having electrical wires protruding in a first direction, said cover having an insertion aperture for said connector and being adapted to receive said connector in said insertion aperture in a direction at right angles to said first direction, and having a guiding aperture for guiding said wires out of said cover in a second direction at right angles to said first direction, the cover further including a supplementary aperture adjoining said guiding aperture, and adapted to guide said wires in a third direction at right angles to said first and second directions.

According to a second aspect the invention provides an electrical connector and cover in combination, said connector having electrical terminals inserted therein, and electrical wires protruding from said connector in the direction of insertion of said terminals, said cover having an insertion aperture therein, and said connector being inserted into said insertion aperture, said cover further including a guiding aperture for guiding said wires out of said cover in a direction at right angles to the direction of insertion of said terminal fittings, wherein said cover includes a supplementary aperture adjoining said guiding aperture and opening in a direction at right angles to said guiding aperture.

Such a cover permits the wires to be bent away from the connector in a direction which does not impede attachment of a closely adjacent connector. The supplementary aperture is preferably arranged to face downwards so as to prevent debris or other foreign matter entering the cover by gravity.

According to a third aspect of the invention, there is provided an electrical connector and cover in combination, the connector being insertable into the cover in an insertion direction, and the cover having an integral guide rail extending in the insertion direction and engageable in a corresponding guide groove of the connector, the connector including elongate terminal fittings inserted therein in a direction at right angles to said insertion direction and being engageable by said guide rail to prevent outward movement thereof.

Such an arrangement permits terminals to be inserted into the connector, and latched against reverse movement as the guide rail engages the guide groove.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
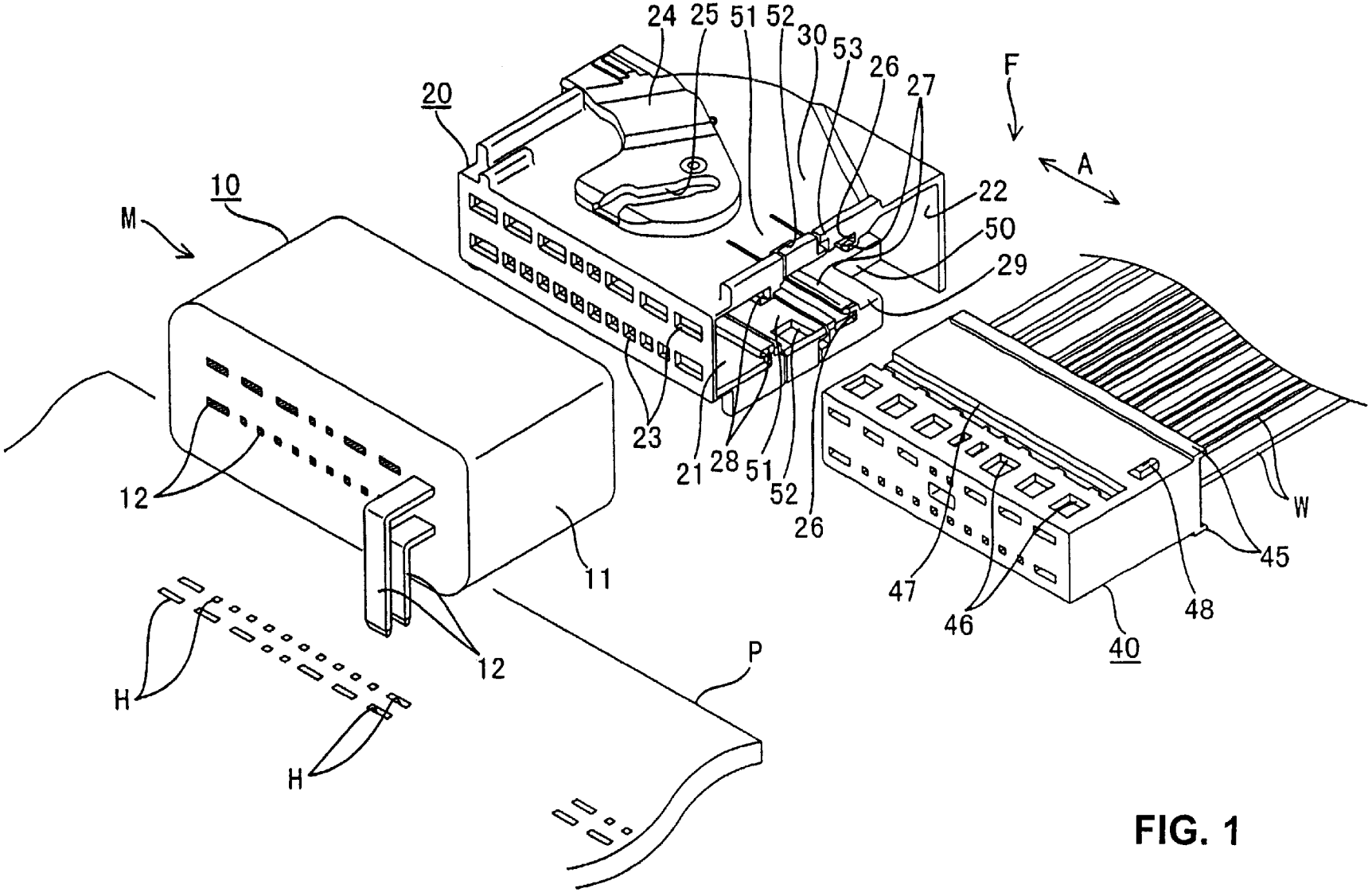
FIG. 1 is a diagonal view of an embodiment of the present invention showing male and female connectors.

An embodiment of the present invention is described below with the aid of FIGS. 1 to 9. As shown in FIG. 1, a female connector F of the present embodiment is formed from a female housing 40 housed within a cover 20, this female connector F being fitted to a male connector M attached to a printed circuit board P. The male and female connectors M and F are fitted in a manner whereby they extend along a face of this printed circuit board P. The fitting faces of the male and female connectors M and F are designated as the anterior sides in this specification. The printed circuit board P extends in a horizontal direction.

The male connector M is provided with a male housing 10 and a hood 11 that is open to the anterior. A plurality of L-shaped male terminal fittings 12 that form an upper and a lower layer and are aligned in a width-wise direction are attached to a posterior face of the male connector M. A lower face of the male housing 10 is attached to the printed circuit board P, and lower ends of the male terminal fittings 12 are fitted into holes H in the printed circuit board P, thereby coming into conductive contact with a conductive path (not shown). The portions of the male terminal fittings 12 provided within the hood 11 of the male housing 10 make contact with female terminal fittings 41 of the female connector F fitted within the hood 11. The width of each male terminal fitting 12 corresponds to the width of each female terminal fitting 41. Furthermore, only two of the closer male terminal fittings 12 have been shown, one upper and one lower; the remaining male terminal fittings 12 are not shown.

The female connector F comprises a cover 20, which has on its outer face a lever 24 used to perform the fitting operation of the male and female connectors M and F; and a female housing 40 that is housed within the cover 20 with the female terminal fittings 41 already in an inserted state in the female housing 40, the female terminal fittings 41 having ends of electric wires W attached thereto. The entirety of side face of the cover is open as illustrated. From its anterior edge, approximately two thirds of this open area forms an attachment hole 21 which allows the female housing 40 to be inserted in a width-wise direction (the direction shown by the arrow A) into the closer side of the open area. The remaining open area, at the farther side, forms a guiding hole 22 that guides the electric wires W extending from the female housing 40. Holes 23 that allow the male terminal fittings 12 of the male connector M to pass therethrough are formed in an anterior face of the cover 20 located at the fitting face of the female connector F. The lever 24 is provided with a cam groove 25. A pin (not shown) provided in the hood 11 of the male housing 10 is capable of fitting into this cam groove 25. The two connectors M and F are fitted together by fitting this pin into the cam groove 25 while rotating the lever 25, and pivoting the lever 24.

A pair of guiding members 27 are provided on mutually opposing upper and lower faces of the cover 20 at the posterior end of the attachment hole 21. These guiding members 27 extend along the direction of insertion of the female housing 40 and are provided with grooves 26 that fit with guiding rails 45 provided on the female housing 40. Furthermore, guide rails, or ribs 28 extend to the anterior of the guiding members 27, these ribs 28 fitting into open grooves 47 in the female housing 40.

Figure 2:
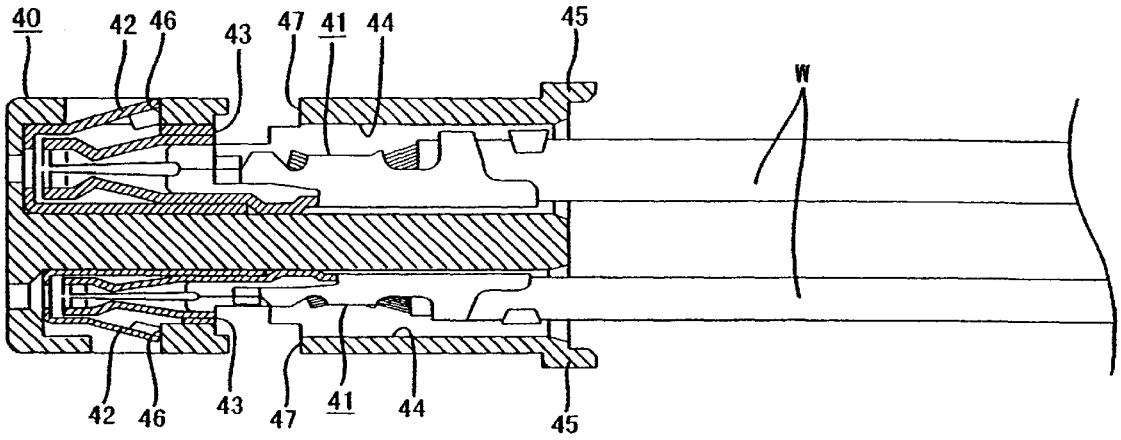
FIG. 2 is a side cross-sectional view of a female housing.

As shown in FIG. 2, the female housing 40 has a plurality of cavities 44 aligned therein at locations that correspond to the male terminal fittings 12. Two different types of female terminal fittings 41, larger and smaller, can be inserted into these cavities 44. The ends of the electric wires W are attached from the posterior to these female terminal fittings 41. When the female housing 40 is to be inserted into the cover 20, the electric wires W that have been led outwards from the posterior of the female housing 40 are bent at approximately a right-angle relative to the direction of insertion of the female terminal fittings 41 into the female housing 40, and are guided so as to extend along the female housing 40 via the guiding hole 22 of the cover 20 (see FIG. 7). These electric wires W are guided in the direction of insertion of the female housing 40, as shown by the arrow A. This arrow A illustrates the horizontal direction.

Figure 4:
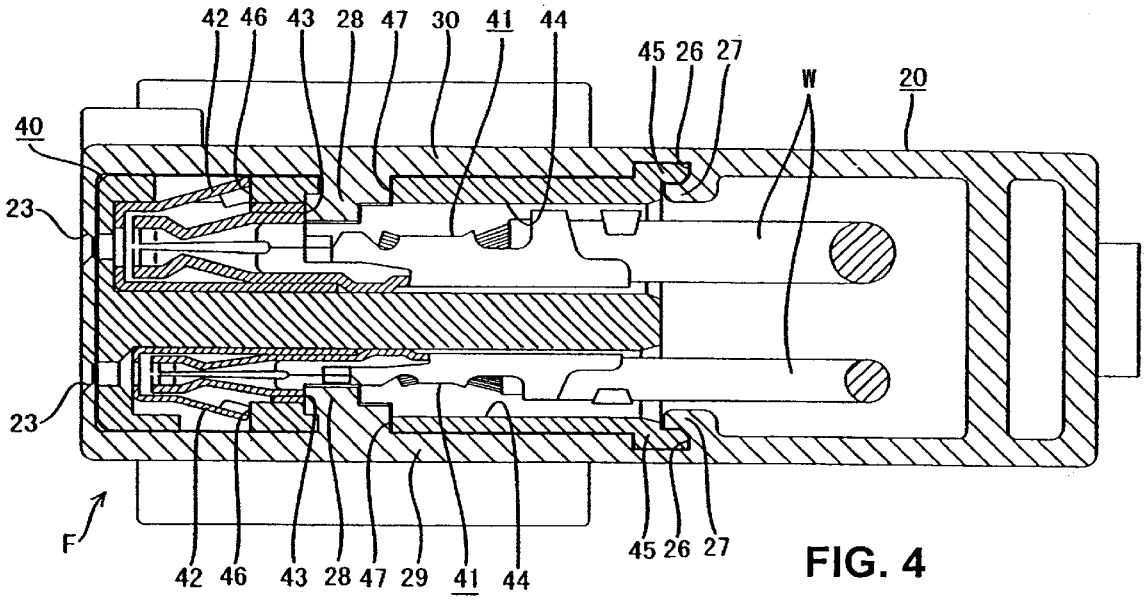
FIG. 4 is a side cross-sectional view showing the female housing in a housed state within a cover.

As shown in FIGS. 1 and 2, the guiding rails 45, which fit into the grooves 26 of the guiding members 27 of the cover 20, protrude towards the posterior from the upper and lower faces of a posterior end face of the female housing 40. Fitting holes 46 open into the upper and lower faces at the anterior end of the female housing 40, metal lances 42 of the female terminal fittings 41 fitting into these fitting holes 46. Open grooves 47 are provided on the upper and lower faces of the female housing 40 at locations to the posterior of the fitting holes 46. These open grooves 47 open out to the upper and lower faces and cut across the cavities 44. As shown in FIG. 4, when the female housing 40 is to be housed within the cover 20, the ribs 28 of the cover 20 fit into the open grooves 47, these ribs 28 consequently fitting with cog members 43 of the female terminal fittings 41.

Figure 8:
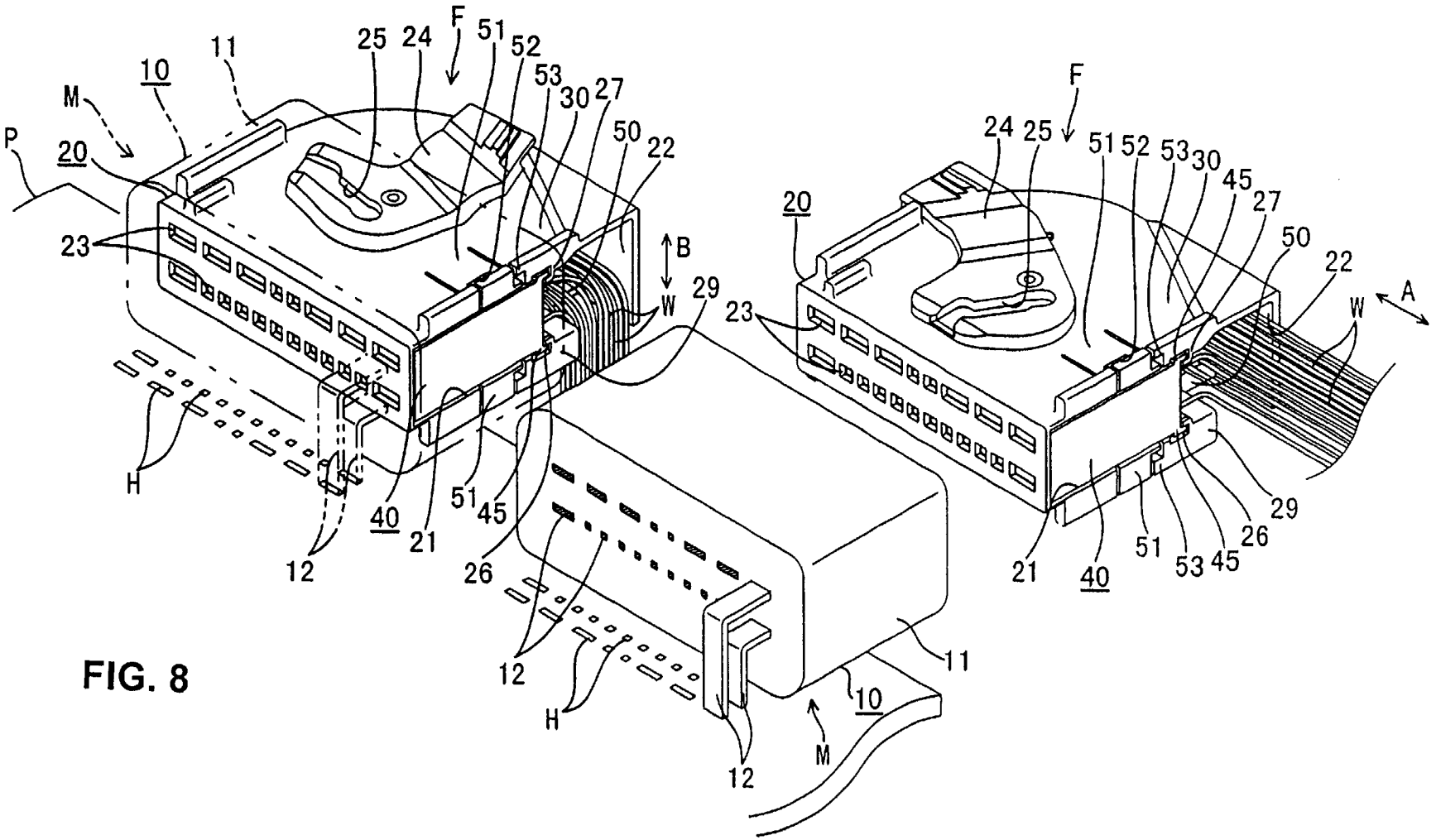
FIG. 8 is a diagonal view showing a farther pair of male and female connectors fitted together, with electric wires thereof being guided from a supplementary guiding hole.

As shown in FIG. 1, a portion of the wall member forming the open-ended guiding hole 22 of the cover 20 is a lower wall 29 that is provided on the lower side relative to FIG. 1. An open portion of this lower wall 29 forms a supplementary guiding aperture 50 that is connected with the guiding hole 22. This supplementary guiding aperture 50 is square, open at the bottom, and extends from a posterior end of the guiding hole 22 along approximately seventy per cent of the entire length of the guiding hole 22. As shown in FIG. 8, the electric wires W extending from the posterior of the female housing 40 are guided downwards, in the direction of the arrow B, from the supplementary guiding aperture 50 in a direction at an approximate right-angles to the arrow A. Since the supplementary guiding hole 50 is connected to the guiding hole 22, the electric wires W are capable of being turned downwards from the side by approximately 90 degrees and can be guided freely from the cover 20. The arrow B illustrates the vertical direction.

Figure 3:
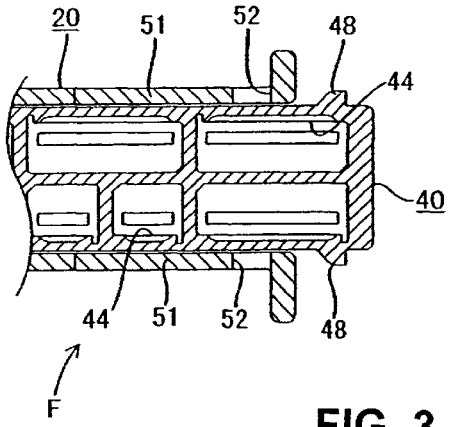
FIG. 3 is a horizontal cross-sectional view showing resilient locking arms and locking protrusions.

A pair of resilient locking arms 51, which extend in the direction of insertion of the female housing 40, are provided on the lower wall 29 and an upper wall 30 formed at the open end of the attachment hole 21 of the cover 20. As shown in FIG. 3, these resilient locking arms 51 have a cantilevered shape, their base end being located at their innermost side, and are capable of bending upwards and downwards. A locking hole 52 opens into each of the free ends thereof, these locking holes 52 fitting with locking protrusions 48 provided at closer ends of the female housing 40. Regulating members 53 protrude from the lower wall 29 and the upper wall 30 at locations somewhat to the right of the resilient locking arms 51. These regulating members 53 are separated from the resilient locking arms 51 in a vertical direction. When the resilient locking arms 51 are in a bent state they make contact with the regulating members 53, and are thus prevented from bending excessively.

The present embodiment is configured as described above. Next the operation thereof will be described. First the attachment operation of the female connector F will be described. After the female terminal fittings 41 have been inserted from the posterior of the female housing 40 into the cavities 44 (see FIG. 2), the electric wires W that protrude from the posterior end of the female housing 40 are bent, and the female housing 40 is inserted into the cover 20 from the closer side thereof via the attachment hole 21. At this juncture, as shown in FIG. 4, the guiding rails 45 fit into the grooves 26 of the guiding members 27, and the ribs 28 fit into the open grooves 47. This guides the insertion of the female housing 40 into the cover 20, and the insertion operation is stable as a result.

Figure 5:
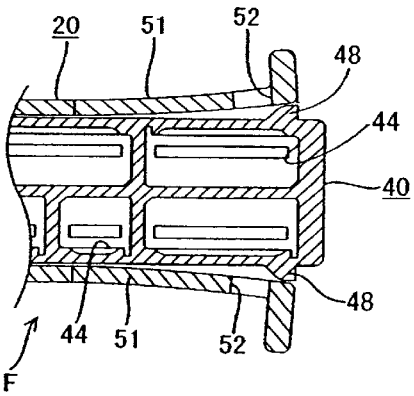
FIG. 5 is a horizontal cross-sectional view showing the resilient locking arms in a bent state.
Figure 6:
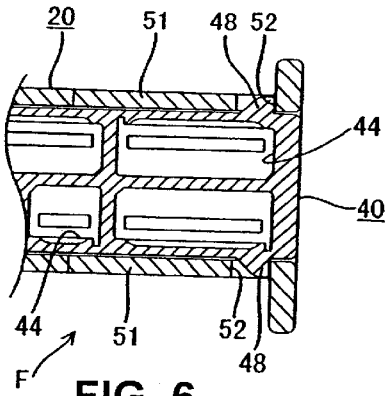
FIG. 6 is a horizontal cross-sectional view showing the resilient locking arms fitting together with the locking protrusions.
Figure 7:
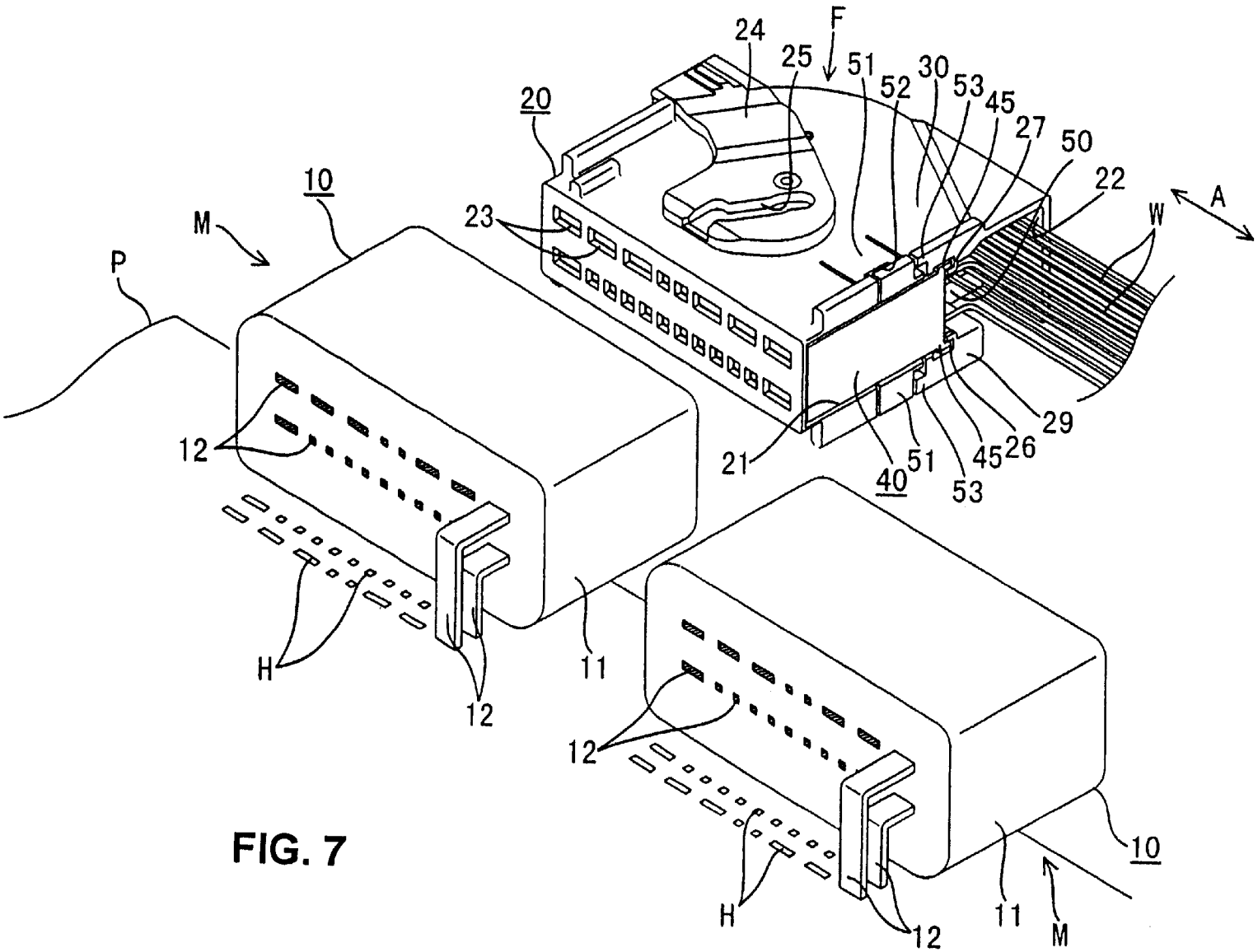
FIG. 7 is a diagonal view showing the female housing housed within the cover.

As shown in FIG. 5, as the insertion operation of the female housing 40 progresses, the resilient locking arms 51 at the top and bottom of the cover 20 bend and rise over the locking protrusions 48 of the female housing 40. Then, as shown in FIG. 6, when the female housing 40 has been inserted to the correct depth, the locking protrusions 48 fit into the locking holes 52 and the resilient locking arms 51 return resiliently to their original position, thereby maintaining the female housing 40 in a state whereby it is entirely housed within the cover 20. At this juncture, as shown in FIG. 7, the electric wires W are bent within the cover 20 and are guided in the direction of the arrow A through the guiding hole 22.

Next the fitting operation of the female connector F (which has been attached in the manner described above) to the male connector M will be described. A case is described in which a farther and a closer pair of male and female connectors M and F are attached (as shown in FIG. 7). In this description, the fitting operation of the farther pair occurs first.

The female connector F of the farther pair is fitted in a shallow manner within the hood 11 of the male housing 10 of the corresponding male connector M. At this juncture, the pin in the hood 11 of the male housing 10 is fitted into the cam groove 25 on the upper face of the lever 24 of the female connector F, and the lever 24 is pivoted. The fitting operation of the two connectors M and F progresses in this manner until the lever 24 has been rotated to the position shown in FIG. 8. At this juncture the two connectors M and F reach a correct fitting state.

As shown in FIG. 8, before the closer pair of male and female connectors M and F are fitted together, the electric wires W of the female connector F of the farther pair, these electric wires W extending towards the closer side from the guiding hole 22, are passed through the supplementary guiding aperture 50 that is open in the downwards direction, and are guided downwards in the direction of the arrow B, thereby temporarily removing these electric wires W from the closer side.

In this manner, the electric wires W of the female connector F of the farther side are guided downwards, thereby leaving the space of the closer side entirely clear and allowing the fitting operation of the closer pair of male and female connectors M and F to be performed. By this means, the fitting operation of the pairs of male and female connectors M and F can be performed easily.

Figure 9:
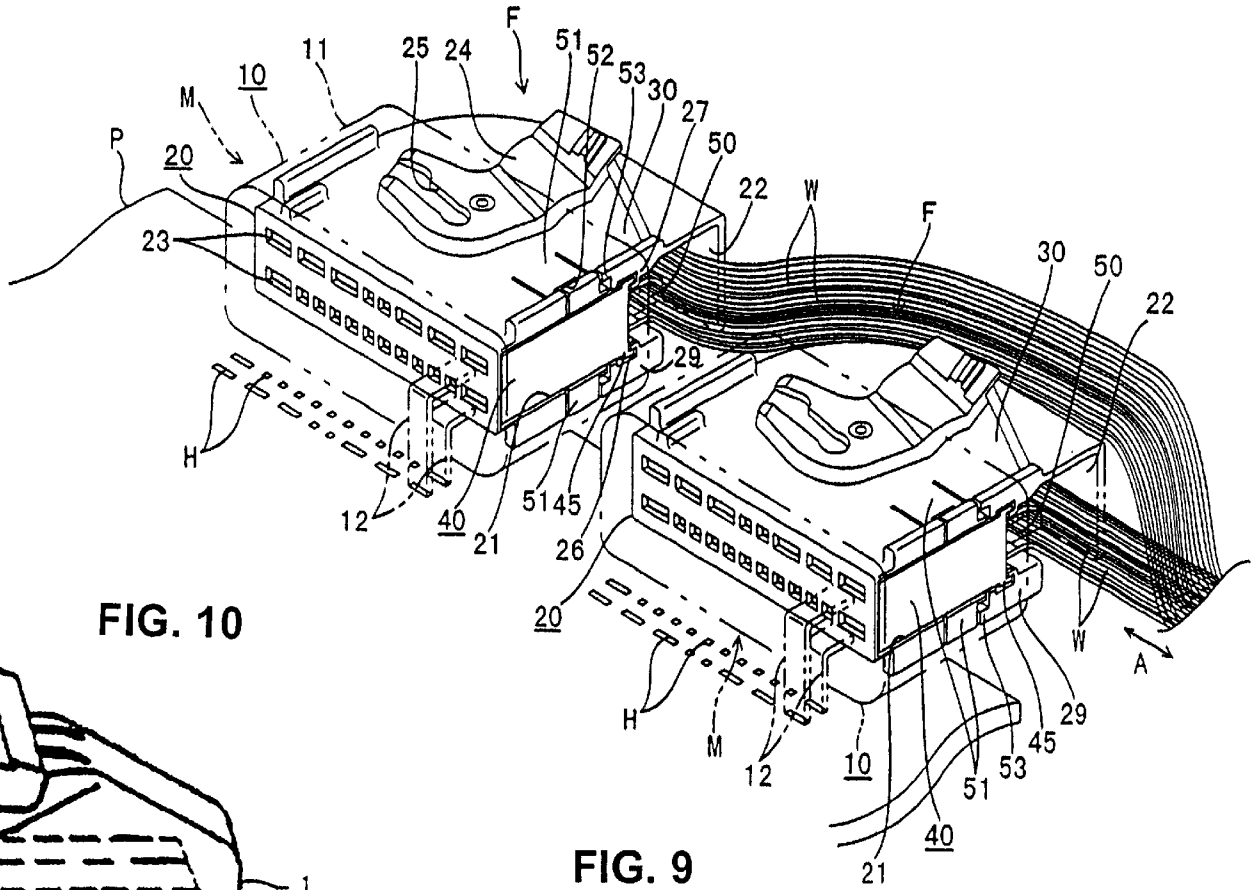
FIG. 9 PRIOR ART
FIG. 9 is a diagonal view showing a closer pair of male and female connectors in a fitted state.
Figure 10:
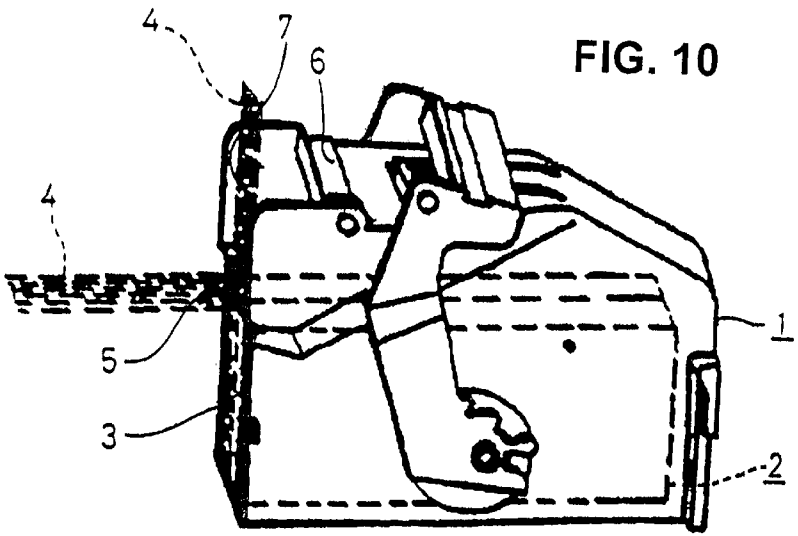
FIG. 10 is a diagonal view of a prior art example.

As shown in FIG. 9, after the fitting operation of the closer pair of male and female connectors M and F has been completed, the electric wires W of the farther female connector F that have been moved into the supplementary guiding aperture 50 are again passed through the guiding hole 22, are guided in the direction of the closer pair of male and female connectors M and F, in the direction of the arrow A, and are passed around the posterior side of the closer female connector F. After this, these electric wires W are brought together with the electric wires W that have been guided through the guiding hole 22 of the closer female connector F.

The male and female connectors M and F are provided along the face of the printed circuit board P in their fitted state, as described above. In this fitted state, the supplementary guiding aperture 50, of the female connector F that is lying flat, is open vertically down. Consequently, foreign matter such as rubbish or dust will not enter the cover 20 through the supplementary guiding hole 50 even if the male and female connectors M and F are left in this fitted state for a long period.

The means for maintaining the female housing 40 are the resilient locking arms 51 and the locking protrusions 48, these being provided on the cover 20 and the female housing 40 at a posterior side relative to the direction of insertion of the female housing 40. As a result, the female housing 40 can easily be removed from the cover 20 for maintenance or the like.

The female housing 40 is held in position by the resilient locking arms 51 in two locations, an upper and a lower location. Consequently, even if the locked state of one of the resilient locking arms 51 is released because it catches with the electric wires W, or for some other reason, the other resilient locking arm 51 will still maintain the female housing 40 within the cover 20. As a result, the female housing 40 is reliably prevented from inadvertently coming out of the cover 20.

The present embodiment may be varied so that the printed circuit board P is positioned in a direction that is at a 90 degree angle to the case described above, thereby being vertical. In this case, the supplementary guiding aperture 50 of the cover 20 will open out towards the side in a horizontal direction. Consequently, foreign matter is not likely to enter the cover 20. That is, the supplementary guiding aperture 50 may open out in other directions depending on the positioning of the printed circuit board P and without permitting debris to enter the aperture 50.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the electric wires of the farther female connector are eventually passed through the guiding aperture. However, in the case where the closer pair of male and female connectors are provided in a location adjacent to the farther pair, the electric wires of the farther pair may be guided only through the supplementary guiding aperture.

(2) The present invention also includes the case where more than two pairs of male and female connectors are aligned.

(3) In the embodiment described above, the case has been described whereby the farther pair of male and female connectors is fitted first. However, in the case where the fitting is performed in the opposite order to that which has been described, and the farther pair of connectors is to be fitted after the closer pair has been fitted, the fitting operation can be carried out with good operability when the electric wires of the farther female connector have been taken through the supplementary guiding hole and led downwards.

(4) In the embodiment described above, a connector has been described wherein the female housing is entirely housed within the cover. However, the present invention is also suitable for other types of connectors. For example, it is suitable for a connector that has a cover clamped thereto, this cover being provided with a fitting groove which fits into a flange provided on a posterior end of a housing.

What is claimed is:

1. A cover for an electrical connector having electrical wires protruding in a first direction, said cover having an insertion aperture for said connector and being adapted to receive substantially all of said connector in said insertion aperture in a direction at right angles to said first direction, and having a guiding aperture for guiding said wires out of said cover in a second direction at right angles to said first direction, the cover further including a supplementary aperture adjoining said guiding aperture, and adapted to guide said wires in a third direction at right angles to said first and second directions.

2. An electrical connector and cover in combination, said connector having electrical terminal fittings, said cover having an insertion aperture therein, and substantially all of said connector being inserted into said insertion aperture, said cover further including a guiding aperture said wires out of said cover in a direction at right angels to the direction of insertion of said terminal fittings, wherein said cover includes a supplementary aperture adjoining said guiding aperture and opening in a direction at right angles to said guiding aperture and said direction of insertion.

3. An electrical connector and cover according to claim 2 wherein said cover is box-like, and said supplementary aperture comprises a cut-out adjacent a comer thereof.

4. An electrical connector and cover according to claim 2 wherein said insertion aperture, guiding aperture and supplementary aperture are connected.

5. An electrical connector and cover according to claim 2 and further including a printed circuit board disposed generally horizontally, said connector and cover being for attachment to an upper side of said board, and said supplementary aperture facing towards said board.

6. An electrical connector and cover according to claim 2 and further including resilient latch provided at the edge of said insertion aperture and adapted to releasably engage said connector to retain said connector in said cover.

7. An electrical connector and cover according to claim 6 wherein a resilient latch is provided on opposite sides of said insertion aperture.

8. An electrical connector and cover according to claim 2 and further including an elongate guide rail within said cover and a corresponding groove of said connector, the guide rail extending in the direction of insertion of said connector, and guiding said connector into said cover.

9. An electrical connector and cover according to claim 8 wherein said guide rail extends at right angles to the direction of insertion of said terminals, the guide rails engaging a respective abutment of said terminals to prevent movement of said terminals against the direction of insertion thereof.

10. An electrical connector and cover according to claim 2 wherein said connector is box-like, and said cover surrounds said connector on five sides, the sixth side corresponding to said insertion aperture.

11. An electrical connector and cover according to claim 10 and further including an elongate guide rail within said cover and a corresponding groove of said connector, the guide rail extending in the direction of insertion of said connector, and guiding said connector into said cover.

12. An electrical connector and cover according to claim 10 and further including resilient latch provided at the edge of said insertion aperture and adapted to releasably engage said connector to retain said connector in said cover.

13. An electrical connector and cover according to claim 12 wherein a resilient latch is provided on opposite sides of said insertion aperture.

14. An electrical connector and cover according to claim 2 wherein said connector is adapted for attachment to a mating connector in a configuration which faces said supplementary aperture down.

15. An electrical connector and cover according to claim 3 wherein said connector is box-like, and said cover surrounds said connector on five sides, the sixth side corresponding to said insertion aperture.

16. An electrical connector and cover according to claim 14 and further including an elongate guide rail within said cover and a corresponding groove of said connector, the guide rail extending in the direction of insertion of said connector, and guiding said connector into said cover.

17. An electrical connector and cover according to claim 14 and further including resilient latch provided at the edge of said insertion aperture and adapted to releasably engage said connector to retain said connector in said cover.

18. An electrical connector and cover according to claim 17 wherein a resilient latch is provided on opposite sides of said insertion aperture.

* * * * *

UNITED STATES PATENT AND TRADEMARK OFFICE

CERTIFICATE OF CORRECTION

PATENT NO. : 6,540,546 B2
DATED : April 1, 2003
INVENTOR(S) : Akinobu Kubo

It is certified that error appears in the above-identified patent and that said Letters Patent is hereby corrected as shown below:

Column 7,
Line 17, "comer" has been replaced with -- corner --.

Signed and Sealed this

Sixteenth Day of September, 2003

JAMES E. ROGAN
*Director of the United States Patent and Trademark Office*